United States Patent [19]

Nakada

[11] 3,994,470

[45] Nov. 30, 1976

[54] MOLD HAVING MEANS FOR POSITIONING A WINDOW FRAME

[75] Inventor: Katsuo Nakada, Kurobe, Japan

[73] Assignee: Yoshida Kogyo Kabushiki Kaisha, Tokyo, Japan

[22] Filed: June 2, 1975

[21] Appl. No.: 582,619

[30] Foreign Application Priority Data

June 14, 1974 Japan ..... 49-69924[U]

[52] U.S. Cl. ..... 249/93; 249/39

[51] Int. Cl.[2] ..... B28B 7/22; E04G 15/02

[58] Field of Search ..... 249/39, 83, 91, 93, 249/207–210; 264/35, 278

[56] References Cited

UNITED STATES PATENTS

| | | | |
|---|---|---|---|
| 1,863,549 | 6/1932 | Lockwood | 264/35 |
| 2,111,577 | 3/1938 | Thomas | 249/83 |
| 2,787,820 | 4/1957 | Shields et al. | 249/39 |
| 3,835,586 | 9/1974 | Gates et al. | 249/39 |

FOREIGN PATENTS OR APPLICATIONS

| | | | |
|---|---|---|---|
| 1,134,455 | 7/1955 | France | 249/39 |

*Primary Examiner*—Francis S. Husar
*Assistant Examiner*—John McQuade
*Attorney, Agent, or Firm*—Hill, Gross, Simpson, Van Santen, Steadman, Chiara & Simpson

[57] ABSTRACT

A form into which concrete is to be poured has several abutments formed in prescribed positions on its bottom. The outer frame of a sash window or the like, which is to be built into a concrete panel to be cast in the form, is placed in the form so as to closely surround the abutments. The outer frame is further removably secured to each abutment by a horizontal bracing rod. A holder frame is placed over the outer frame to urge the latter into tight contact with the bottom of the form.

5 Claims, 4 Drawing Figures

MOLD HAVING MEANS FOR POSITIONING A WINDOW FRAME

BACKGROUND OF THE INVENTION

1. Field of the Invention

This invention relates to fixtures or jigs for use in the factory precasting of concrete panels with built-in outer frames of sash windows or the like.

2. Prior Art

In the art of prefabrication of buildings it is desirable, for higher efficiency of construction, to precast concrete wall panels integral with the outer frames of sash windows or the like, rather than to install such outer frames in the walls of a building on the site. For the production of such precast concrete panels with built-in outer window frames or the like, it is customary to place the outer frame around and in contact with several abutments fixedly mounted in prescribed positions on a platform constituting the bottom of a form into which concrete is to be poured. A holder frame is then placed over the outer frame to force same down into close contact with the platform.

If, in the above described conventional fixture means, the outer frame is not forced into sufficiently close contact with the platform, the concrete poured into the form will intrude into the inside of the outer frame through a space between the platform and the bottom edge of the outer frame. Exertion of any undue downward forces on the outer frame, however, would cause the shelf or wall portions of the outer frame, which are arranged perpendicular to the platform, to buckle outwardly or inwardly depending upon the position of the holder frame relative to the outer frame and the cross sectional shape of the outer frame.

SUMMARY OF THE INVENTION

It is therefore a general object of this invention to provide a fixture device for securely but removably holding the outer frame of a sash window or like panel assembly in position within a form in the production of a precast concrete panel integral with the outer frame.

A more specific object of the invention is to provide a fixture device such that the intrusion of concrete into the inside of the outer frame within the form can be prevented with out causing deformation of the outer frame.

Briefly, the fixture device according to the invention includes a plurality of abutments fixedly mounted in prescribed positions on the bottom of a form into which concrete is to be poured for the production of a precast concrete panel. The outer frame of a sash window or the like to be built in the concrete panel is placed flat on the bottom of the form, with the abutments located internally of the outer frame for abutting contact therewith. Bracing rods secure the outer frame to the respective abutments in a readily removable manner. A holder frame is placed over the outer frame and is urged against it to force the outer frame into close contact with the bottom of the form.

Thus, if sufficiently great force is exerted to urge the outer frame into tight contact with the bottom of the form, and hence to prevent the intrusion of the concrete into the inside of the outer frame, the outer frame will suffer no buckling because it is secured to the abutments by the bracing rods. The concrete panel precast in this manner is pleasing in appearance, and the sashed of the window or the like can be later easily installed into the outer frame built in the panel.

The features which are believed to be novel and characteristic of this invention are set forth in particular in the appended claims. The invention itself, however, both as to its organization and the functions of various parts, together with additional objects and advantages thereof, will be best understood from the following description of a typical embodiment taken in connection with the accompanying drawings in which like reference characters refer to like parts of the several views.

DESCRIPTION OF THE PREFERRED EMBODIMENT

Figure 1:
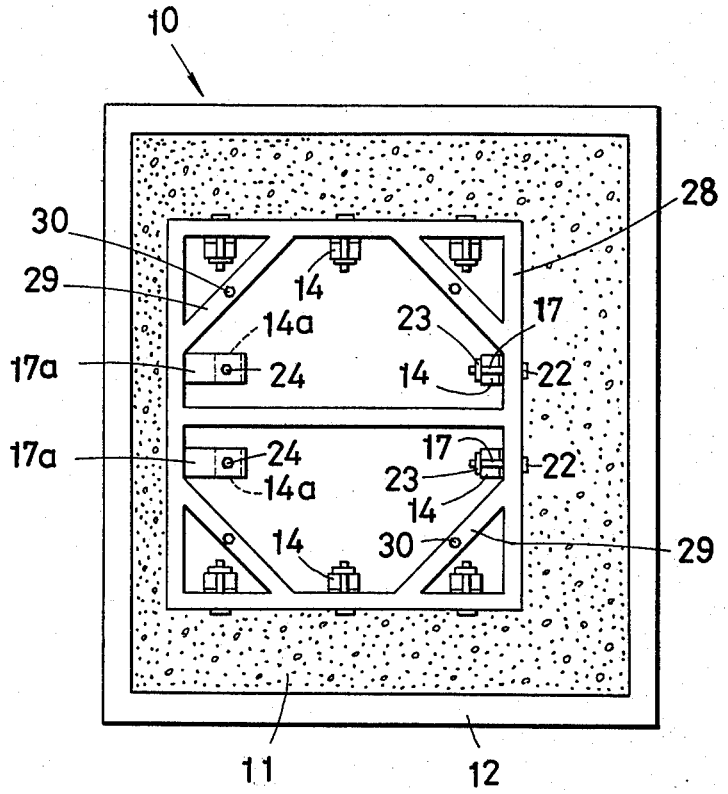
FIG. 1 is a top plan view of the arrangement for precasting a concrete wall panel integral with the outer frame of a dual sash window assembly, the arrangement including a preferred form of the fixture device according to this invention.
Figure 2:
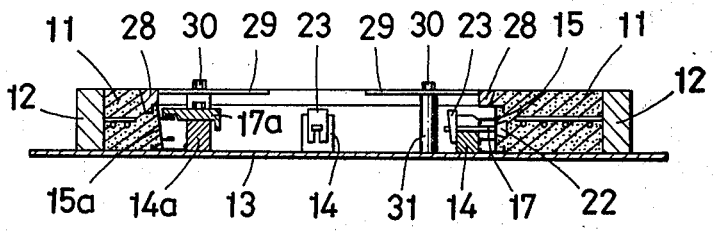
FIG. 2 is a vertical cross-sectional view of the arrangement shown in FIG. 1.
Figure 3:
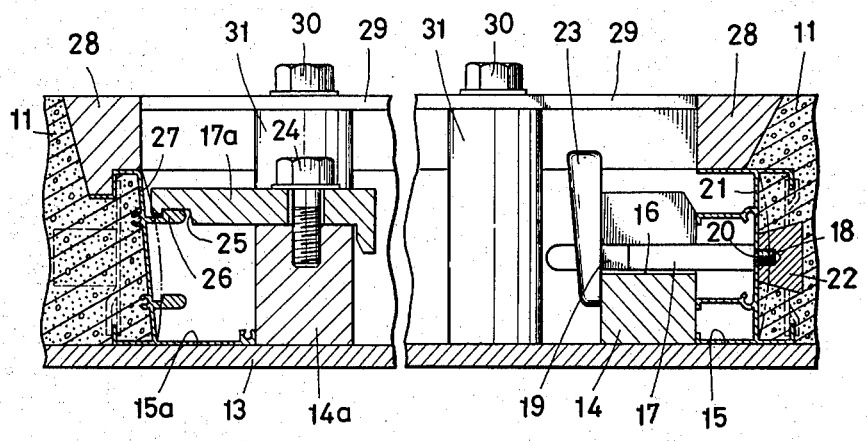
FIG. 3 is a view similar to FIG. 2, but enlarged and partly broken away, showing the fixture device according to the invention in greater detail.

The invention is described more specifically as adapted for the production of a precast concrete wall panel with a built-in outer frame of a horizontally moving, dual sash window assembly. With reference generally to FIGS. 1, 2 and 3, a form 10 retains concrete 11 in the shape of the desired wall panel. The form 10 comprises four side panels 12 arranged rectangularly, in addition to a horizontal platform or bottom 13.

Fixedly mounted in predetermined positions on the platform 13 are a plurality of abutments 14 and **14*a* that are arranged internally of the generally rectangular outer frame of the dual sash window assembly for abutting contact therewith. The outer window frame has a header 15 and a still 15*a*. The side jambs of the outer window frame are not shown because they can be held in position by the same means and in essentially the same manner as the header 15**.

Figure 4:
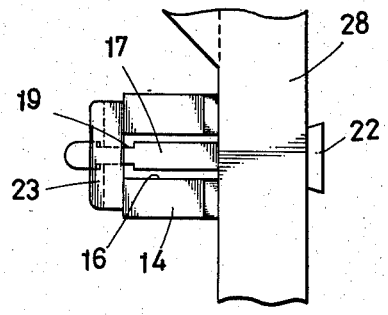
FIG. 4 is a fragmentary enlarged top plan view showing in greater detail means for holding the header of the outer window frame in position in the arrangement of FIG. 1.

The fixture means for use with the header 15 is best shown in FIGS. 3 and 4. One or more, two in the illustrated embodiment, of the abutments 14 arranged internally of the header 15. Each abutment has a groove 16 extending vertically downwardly from its top in right angular relationship to the header 15. Received in this groove 16 is a bracing rod 17 having an external screw thread 18 at one end and a constricted neck 19 adjacent the other end.

The threaded end 18 of the bracing rod 17 projects outwardly of the header 15 through a bore 20 formed in its upper wall 21 which is here arranged perpendicular to the platform 13 but which, of course, is to be disposed horizontally when the completed wall panel is later incorporated in a building. A cap or nut 22, which is frustoconical in shape, has a tapped hole for receiving the threaded end 18 of the bracing rod 17 projecting out of the bore 20 in the wall 21. A wedge 23 is bifurcated at one end to straddle the neck 19 of the bracing rod 17 and is driven in between the abutment 14 and the said other end of the bracing rod. The header 15 of the outer window frame is thus fixed in position and is forced toward the abutments 14 by the horizontal bracing rods 17.

The sill 15*a* is held by one or more abutments 14*a*, two in the illustrated embodiment. Each of the abutments 14*a* has a horizontal bracing rod 17*a* secured thereto by a screw 24 or like fastener. The bracing rod 17*a* extends toward the sill 15*a* and has recess 25 in which a flange engages. The flange is formed on one of the usual pair of bottom rails 26 that are extend lengthwise on the lower wall 27 of the sill in parallel spaced relationship to serve as tracks for the respective sashes of the window assembly.

A generally rectangular holder frame 28 is then placed over the outer window frame. The holder frame 28 includes beams 29 arranged obliquely adjacent its four corners, and a screw 30 or like fastener is inserted through each of these four beams 29 into one of four short columns 31, respectively, that are securely mounted in suitably selected positions on the platform 13. The holder frame 28 is thus urged downwardly against the outer window frame, which in turn is urged downwardly against the platform 13 for close contact therewith.

With the outer frame of the dual sash window assembly fixed in position within the form 10 by the above described fixture device, concrete 11 may be poured into the form excluding the space bounded by the outer window frame.

The holder frame 28 pressed against the outer window frame exerts forces tending to cause the walls 21 and 27 of the header 15 and sill 15*a*, as well as the corresponding walls of the side jambs, to buckle as indicated by the dot-and-dash lines in FIG. 3. The buckling does not occur, however, because the walls 21, 27 are secured to the abutments 14 and 14*a* by the bracing rods 17 and 17*a*.

Upon solidification of the concrete, the screws 30 may first be loosened to free the holder frame 28 from the outer window frame. The wedges 23 are withdrawn and then the bracing rods 17 are unscrewed from the caps 22; the bracing rods 17*a* are freed merely by loosening the screws 24.

All of the various objects set forth heretofore are fully realized by the fixture device as described. The invention itself, however, is understood to be inclusive of various modifications or changes which will be readily resorted to by those skilled in the art on the basis of this disclosure, without departing from the spirit or scope of the following claims.

I claim:

1. Apparatus for holding a window frame while it is being cast into a concrete panel, comprising:

a. a form having a horizontal bottom adapted to support the window frame on one side around its periphery;

b. a plurality of abutments secured to said bottom in position to act against the inside of the window frame;

c. a plurality of horizontal bracing rods each adapted to be removably connected at one end to the window frame and removably connected at the other end to one of said abutments;

d. a horizontal holder frame adapted to engage the window frame on its opposite side around its periphery; and e. means acting between said holder frame and said bottom adapted to clamp the window frame into close contact with said bottom.

2. Apparatus according to claim 1, the window frame having three walls forming its header and side jambs which are perpendicular to said bottom, in which certain of said bracing rods are adapted to secure the three window frame walls to said abutments

3. Apparatus according to claim 1, which further includes:

a. means defining a passage through at least one of said abutments through which one of said bracing rods extends;

b. said one bracing rod having a threaded end for projecting through a hole in the window frame;

c. a threaded cap on said threaded end of said rod adapted for bearing against the window frame; and d. means acting on the other end of said one rod for tensioning said one rod;

whereby said frame window can be drawn horizontally against said one abutment.

4. Apparatus according to claim 1, the window frame having a sill with a flanged rail which is parallel to said bottom, in which the connection at said one end of at least one of said bracing rods to the window frame is provided by a downwardly facing groove receptive of the rail.

5. Apparatus according to claim 3 in which the other end of said bracing rod includes a reduced neck portion partially projecting from said abutment, said tensioning means being wedge means received in said neck portion and acting between said other end and said abutment.

* * * * *